US008708179B2

(12) United States Patent
Stevenson

(10) Patent No.: US 8,708,179 B2
(45) Date of Patent: Apr. 29, 2014

(54) PRODUCT PACKAGING

(75) Inventor: Kevin T. Stevenson, Upland, CA (US)

(73) Assignee: F.D.S. Manufacturing Company, Pomona, CA (US)

( * ) Notice: Subject to any disclaimer, the term of this patent is extended or adjusted under 35 U.S.C. 154(b) by 171 days.

(21) Appl. No.: 13/103,048

(22) Filed: May 7, 2011

(65) Prior Publication Data

US 2011/0297674 A1 Dec. 8, 2011

Related U.S. Application Data

(60) Provisional application No. 61/352,446, filed on Jun. 8, 2010.

(51) Int. Cl.

| | |
|---|---|
| ***B65D 6/18*** | (2006.01) |
| ***B65D 8/14*** | (2006.01) |
| ***B65D 43/22*** | (2006.01) |
| ***B65D 85/72*** | (2006.01) |

(52) U.S. Cl.
USPC ..... 220/6; 220/839; 220/833; 220/4.04; 220/4.05; 206/485; 426/106; 221/312 C

(58) Field of Classification Search
USPC ..... 220/4.23, 839, 833, 4.24, 4.22, 4.25, 6, 220/837, 4.01, 4.04, 4.05, 588; 229/902, 229/938; 426/106; 221/312 C; 206/485
See application file for complete search history.

(56) References Cited

U.S. PATENT DOCUMENTS

| | | | | |
|---|---|---|---|---|
| 2,959,339 | A * | 11/1960 | Sierk et al. | 206/485 |
| 4,189,054 | A * | 2/1980 | Liu et al. | 220/4.23 |
| 4,234,080 | A * | 11/1980 | Gellert | 206/0.82 |
| 4,792,046 | A * | 12/1988 | Taylor | 206/523 |
| 5,938,068 | A * | 8/1999 | Atkins et al. | 220/839 |
| 6,006,945 | A | 12/1999 | Kirkland | |
| 2005/0208186 | A1 | 9/2005 | Kirkland | |
| 2007/0009632 | A1 * | 1/2007 | Cadiente et al. | 426/106 |
| 2008/0023472 | A1 * | 1/2008 | Brandt | 220/4.23 |
| 2008/0029345 | A1 * | 2/2008 | Shafir | 186/35 |

* cited by examiner

*Primary Examiner* — Anthony Stashick
*Assistant Examiner* — Jennifer Castriotta

(57) ABSTRACT

A product packaging device includes side portions. Each of the side portions includes a first end portion, a second end portion and a loading portion. The side portions fold together for closing the product packaging device.

17 Claims, 7 Drawing Sheets

100

PRODUCT PACKAGING

CROSS-REFERENCES TO RELATED APPLICATIONS

This application claims priority from U.S. provisional patent application Ser. No. 61/352,446, filed on Jun. 8, 2010, incorporated herein by reference.

BACKGROUND

1. Field

The embodiments relate to product packaging, and in particular to apparatus and methods for packaging fresh products.

2. Description of the Related Art

Fresh foods that are supplied at locations for sale in vending machines are typically loaded in vending machines that have a particular holding compartment that is rotated to allow the content to be dispensed through a window opening. These types of vending machines are limited in the amount of products that they can vend due to the limited space and footprint of typical vending machines.

SUMMARY

One embodiment of the invention comprises an apparatus including a product packaging device includes side portions. Each of the side portions includes a first end portion, a second end portion and a loading portion. The side portions fold together for closing the product packaging device.

Another embodiment of the invention comprises a product packaging device including a plurality of side portions. Each of the side portions comprising: a first end portion including a first ventilation portion, a second end portion including a second ventilation portion, and a loading portion. The plurality of side portions fold together along perforations for closing the product packaging device.

Yet another embodiment of the invention comprises a method providing a flat stackable product packaging device including a plurality of side portions. Each side portion comprising: a first end portion, a second end portion, and a loading portion. One or more of the side portions is loaded with content. The plurality of side portions are folded toward one another with at least one side portion overlapping another side portion. The product packaging device is closed using a closure portion from the at least one side portion that overlaps the other side portion.

Other aspects and advantages of the present invention will become apparent from the following detailed description, which, when taken in conjunction with the drawings, illustrate by way of example the principles of the invention.

BRIEF DESCRIPTION OF THE DRAWINGS

The embodiments are illustrated by way of example, and not by way of limitation, in the Figures of the accompanying drawings and in which like reference numerals refer to similar elements and in which.

DETAILED DESCRIPTION

The following description is made for the purpose of illustrating the general principles of the invention and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

The description may disclose several preferred embodiments of vending product packaging, as well as operation and/or component parts thereof. While the following description will be described in terms of vending product packaging for clarity and to place the invention in context, it should be kept in mind that the teachings herein may have broad application to all types of systems, devices and applications.

One embodiment of the invention provides an apparatus including a product packaging device includes side portions. Each of the side portions includes a first end portion, a second end portion and a loading portion. The side portions fold together for closing the product packaging device.

Figure 1:
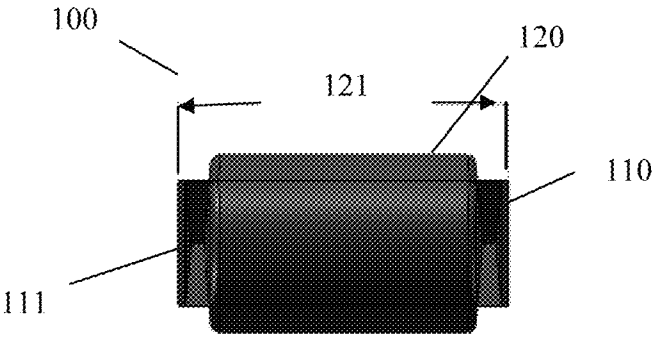
FIG. 1 illustrates a side view of a product packaging device shown in an assembled state according to one embodiment of the invention.

FIG. 1 illustrates an assembled product packaging device or container 100 according to one embodiment of the invention. In one example, the product packaging device 100 may be manufactured by a thermoforming, injection molding, or any equivalent forming processes. In one example the raw material may comprise a flat extruded sheet of recycled and recyclable polyethylene terephthalate (PET) plastic resin, polypropylene, PVC, polystyrene, etc. (e.g., recycled water bottles, soda bottles, etc.). In one embodiment of the invention, the product packaging device 100 includes a first end portion 110, a second end portion 111 and side portions 120. In one embodiment of the invention, the length 121 of the product container 100 may range from X-Y.

Figure 2:
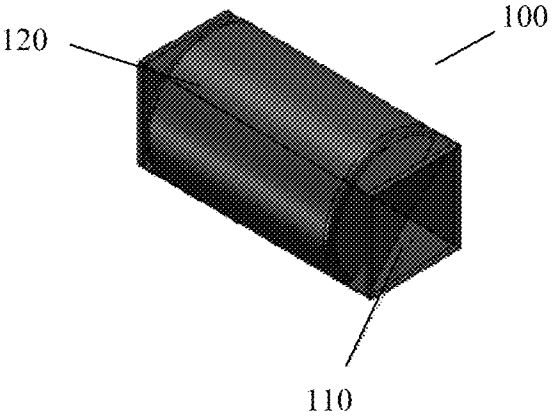
FIG. 2 illustrates a side perspective view of a product packaging device shown in an assembled state according to one embodiment of the invention.

FIG. 2 illustrates a side perspective view of the product packaging device 100 shown in an assembled state according to one embodiment of the invention. As shown, the product packaging device 100 includes curved shaped side portions 120 that form a cylindrical shaped product packaging device 100 when the side portions are folded together. In one embodiment of the invention, the end portions 110 and 111 may be square shaped when formed by folding multiple side portions together that have triangular-like shaped ends. In one example, the end portion 110 is completely closed.

Figure 3:
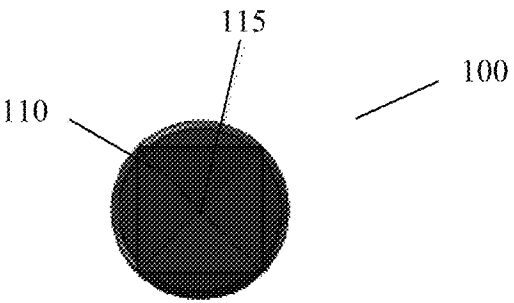
FIG. 3 illustrates an end view of a product packaging device shown in an assembled state according to one embodiment of the invention.

FIG. 3 illustrates an end view of the product packaging device 100 shown in an assembled state according to one embodiment of the invention. In one example, the product packaging device 100 includes multiple similar shaped side portions 120 that are hinged together. When the side portions 120 are folded together they form one complete 360 degree round cylindrical (e.g., similar to a beverage can) container that is not manufactured in the same way bottles and cans are. In one example, a plurality of side portions 120 may be any even divisor of 360° plus one.

In one embodiment of the invention, each side portion 120 may have a designed shape on each end portion 110 and 111. In one example, the end portions may comprise shaped pockets that allow the folded/assembled product packaging device 100 to have closed or vented ends. In one example, the end portion 110 and 111 may comprise shapes that are designed to allow the last side portion 120 to overlap a first side portion 120 creating a closed wrap 115 and engaging the last side portion's 120 end shapes into the first side portion's 120 end shapes for engagement, e.g., snapping the product packaging device 100 closed.

Figure 4:
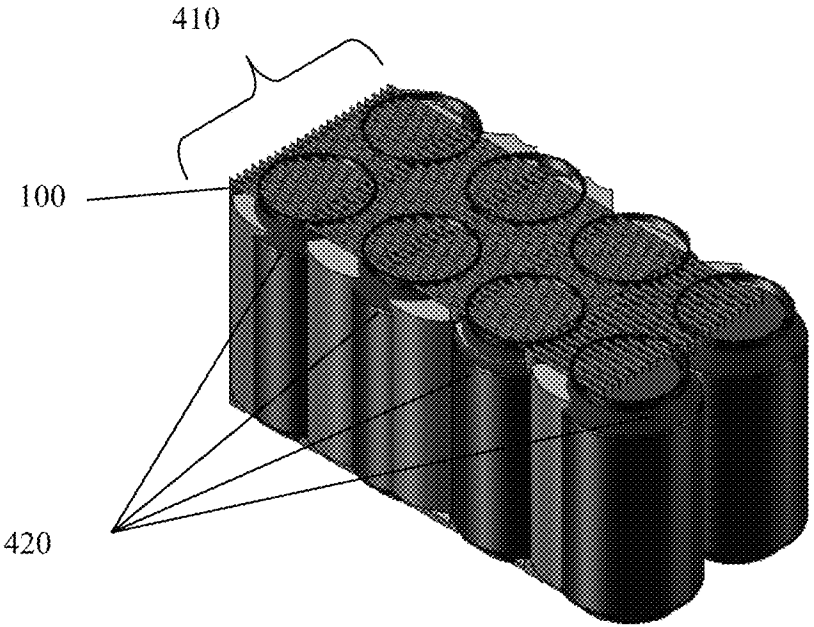
FIG. 4 illustrates a perspective view of a plurality of stacked product packaging devices shown in an unassembled state according to one embodiment of the invention shown in contrast to soda cans for a displacement comparison.

FIG. 4 illustrates a perspective view of a plurality (e.g., 22) 410 of stacked product packaging devices 100 shown in an unassembled state according to one embodiment of the invention as shown in contrast to soda cans 420 for a displacement comparison. In one example, the product packaging device 100 has a 275% shipping advantage as to any current cylindrical design. This can be seen by the illustrated overlay of twenty two (22) product packaging containers 100 stacked in an unassembled state with eight 12 ounce soda containers. The stacking ability of the product packaging device 100 allows shipping the product packaging devices 100 economically to packers.

In one example, the product packaging devices 100 are stacked or nested together to enhance shipping to processors or content providers. In this example, the processors de-nest the nested flat unassembled product packaging devices 100 onto a conveyor or other transport mechanism, table, etc. The processors are then able to load their product content onto the flat unassembled product packaging devices 100. The unassembled flat product packaging devices 100 can then be folded around with the last side portion 120 engaging the first side portion 120 for closing the assembled product packaging device 100 containing the desired content.

Figure 6:
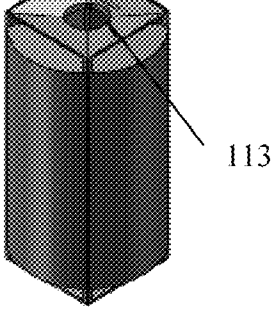
FIG. 6 illustrates a perspective view of a product packaging device shown in an assembled state according to one embodiment of the invention.
Figure 5:
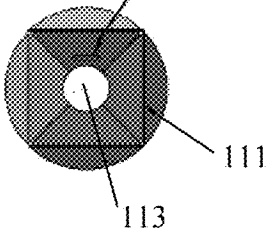
FIG. 5 illustrates an end view of a product packaging device having an open end shown in an assembled state according to one embodiment of the invention.
Figure 8:
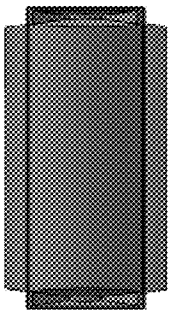
FIG. 8 illustrates a right side view of a product packaging device shown in an assembled state according to one embodiment of the invention.
Figure 7:
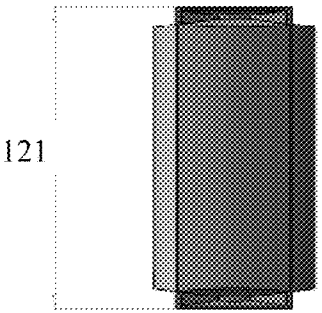
FIG. 7 illustrates a left side view of a product packaging device shown in an assembled state according to one embodiment of the invention.

FIG. 5 illustrates an end view of a product packaging device 100 having a second end portion 111 (being in an open or ventilation state) shown in an assembled state according to one embodiment of the invention. As shown, the product packaging device 100 includes an opening 113 and a closure portion 112. In one example, the closure portion is a groove or slot that allows a last side portion 120 having a closure portion 112 to snap its closure portion 112 into a side portion 120 that it overlaps with in order to form an assembled product packaging device 100. In on example, the closure portion 112 may be opened and closed multiple times. In another example, the closure portion 112 is designed to be snapped once for closing the product packaging device 100 in an assembled state, and when the product packaging 100 is opened, the closure portion 112 is incapable of being snapped again. In one embodiment of the invention, since the product packaging device 100 includes a closure portion 112, the product packaging device 100 does not require a separate cap, lid or other type of closing device FIG. 6 illustrates a perspective view of the product packaging device. 100 shown in an assembled state according to one embodiment of the invention. FIG. 7 illustrates a left side view and FIG. 8 illustrates a right side view of the product packaging device 100 shown in an assembled state according to one embodiment of the invention. In one embodiment of the invention, the shape of the end portions 110 and 111 enhance the strength of the assembled product packaging device 100 for horizontal and vertical stacking of assembled product packaging devices 100 that are packed with products, such as fresh fruit, bagged goods, loose goods, etc.

Figure 9:
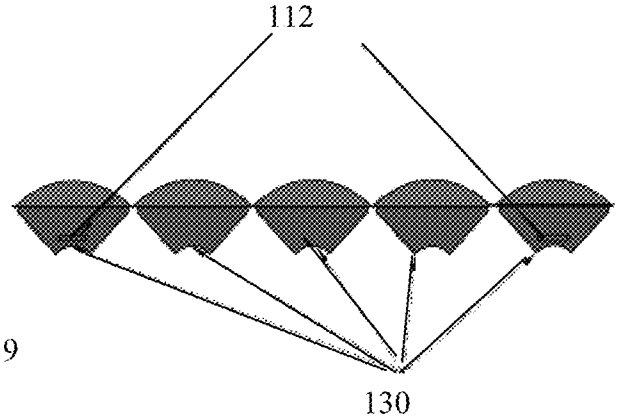
FIG. 9 illustrates a side view of a product packaging device shown in an unassembled and empty state according to one embodiment of the invention.

FIG. 9 illustrates a side view of the product packaging device 100 shown in an unassembled and empty state according to one embodiment of the invention. In one example, the inner opening portion 130 may be sized or filled to alter the opening 113 as desired for creating a larger opening 113, completely closing the opening 113, and various in-between sized openings 113.

Figure 10:
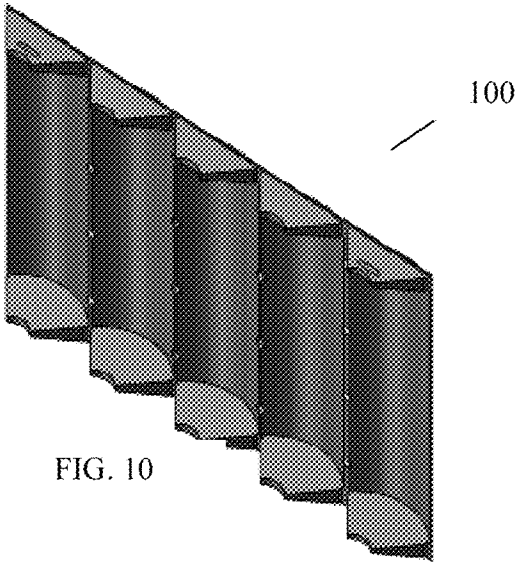
FIG. 10 illustrates a top perspective view of a product packaging device shown in an unassembled and empty state according to one embodiment of the invention.
Figure 11:
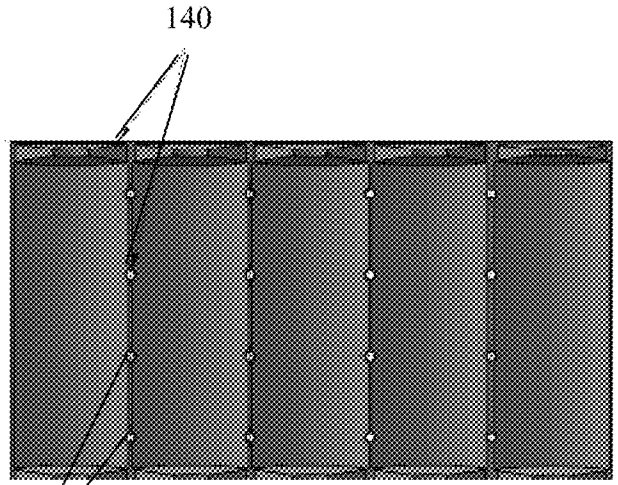
FIG. 11 illustrates a bottom view of a product packaging device shown in an unassembled and empty state according to one embodiment of the invention.

FIG. 10 illustrates a top perspective view of the product packaging device 100 and FIG. 11 illustrates a bottom view of the product packaging device 100, shown in an unassembled and empty state according to one embodiment of the invention. In one example, the product packaging device 100 includes perimeter trim or perforation 140 on the same horizontal plane. In one example, this means that cutting is achieved on one surface. In one embodiment of the invention, the product packaging device 100 includes openings 150 that are on the same plane as the vertical perimeter. In one example, the openings 150 improve air flow into the product packaging device 100. The openings 150 may be sized as desired or completely removed depending on the type of products to be packaged and required ventilation or non-ventilation within the product packaging device 100. In some embodiments of the invention, the openings 150 are sized depending on the size of the end opening 113. It should be noted that the perimeter perforation are on the same plane as the perimeter trim, which allows the openings 150 to be cut through the cylindrical side portions 120 of the product packaging 100 in the flat unassembled state. This is an important feature that cylinder type packages cannot otherwise provide.

Figure 12:
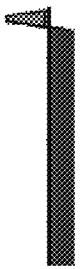
FIG. 12 illustrates an upright side view of a product packaging device shown in an unassembled and empty state according to one embodiment of the invention.

FIG. 12 illustrates an upright side view of a product packaging device 100 shown in an unassembled and empty state according to one embodiment of the invention. In one example, the product packaging device 100 may be placed within a vending machine that is designed to vend cans as the product packaging devices have a similar shape. The product packaging devices 100 may be stacked for shipping similar to cans or bottles for vending applications. In these examples, the product packaging device 100 may be designed to adapt to different vendible can dimensions and to all vendible bottle dimensions.

Figure 13:
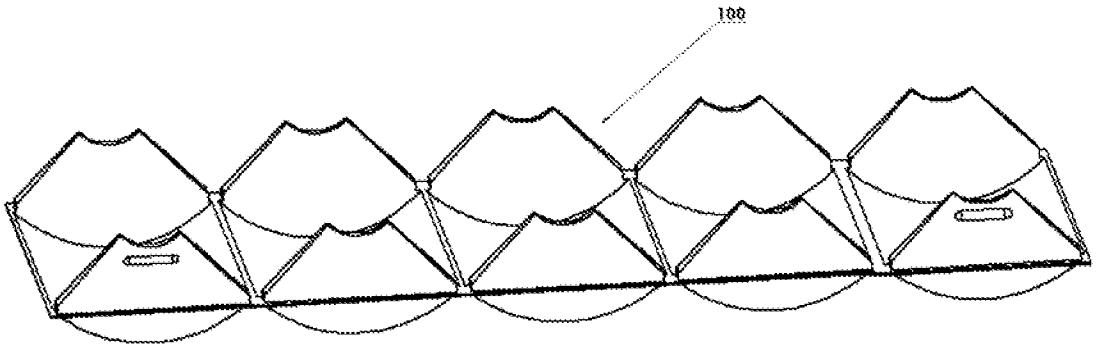
FIG. 13 illustrates a side perspective view of a product packaging device shown in an unassembled and empty state according to one embodiment of the invention.
Figure 14:
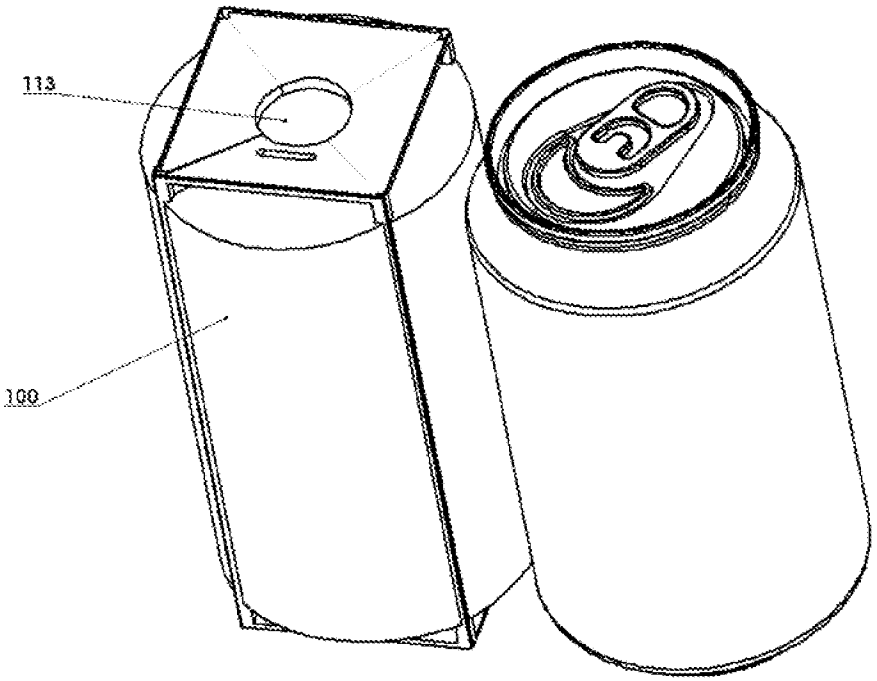
FIG. 14 illustrates a perspective view of a product packaging device shown in an assembled and empty state according to one embodiment of the invention.

FIG. 13 illustrates a photograph of a side perspective view of the product packaging device 100 shown in a flat unassembled and empty state according to one embodiment of the invention. FIG. 14 illustrates a photograph of a perspective view of the product packaging device 100 shown in an assembled and empty state according to one embodiment of the invention. As shown, the can is used for a visual size comparison. In some embodiments of the invention, the product packaging device 100 is loaded with content in the flat and un-assembled state. In one example, filling of the product packaging device 100 does not require inserting product content into a tube like container. In these embodiments of the invention, the product packaging device 100 is efficient to manufacture, ships efficiently when loaded with fruit and food products. The product packaging device 100 may be filled with content via manual (e.g., by hand) or via machine loading.

In one example, the width of the flat unloaded product packaging device 100 may range from 8-14 in., preferably about 9.2 in. In this example, the length of the flat unloaded product packaging device 100 may range from 4-9 in., preferably about 4.8 in. In this example, the height of the flat unloaded product packaging device may range from 0.75-3 in., preferably about 1 in. In one embodiment of the invention, the angle between each side portion triangular like portion is about 90° . In one example, the radius of the inner opening portion 130 may range from 0-1 in., preferably 0.375 in. It should be noted that other sizes, shapes, radii, etc. may be provided by other embodiments of the invention.

In one example, the product packaging device 100 is fully functional for existing processing lines for content placement. In some embodiment of the invention, the product packaging device 100 is fully recyclable in nature.

It should be noted that the above-mentioned embodiments overcome the problems of typical vending packaging that do not have means to provide ventilation to a fresh food product. In one embodiment of the invention, the product packaging device 100 is made of one integral piece with a built in closure feature. In one example, the product packaging device 100 is made with one homogeneous recyclable material.

In some embodiments of the invention, the design of the end portions 110 and 111 of the product packaging device 100 serve a dual purpose as to provide the structural rigidity for column loading in a vending machine and to provide closing or leaving an opening 113 for ventilation.

In a standard can vending machine, there are approximately nine different available size drink containers that will fit into the machine. These typical containers vary in diameter and length. In one embodiment of the invention, depending on the product desired to be dispensed, the product packaging device 100 may be sized to meet any typical size and dimension. In another example, the closure portion 112 may be designed as desired to suit the fit/feel for closure of the product packaging device 100.

It should be noted that the product packaging device 100 does not only have to be provided for vending applications. Many types of products can be packaged in the product packaging device 100 and sold in retail stores. Food items and non-food items may all be sold in the product packaging device 100 if they fit within the boundaries. In some embodiments of the invention, suspension type details or ribs may be formed within the cylindrical shape to create more strength or cushioning as desired for particular products.

In another example, the product packaging device 100 does not include a cylindrical shape. In this example, the product packaging device 100 may be designed to have a square structure when folded. It should be noted that when the product packaging device 100 is not limited to being placed in a vending machine, all physical dimensions may be altered to suit the customer's needs.

Figure 15:
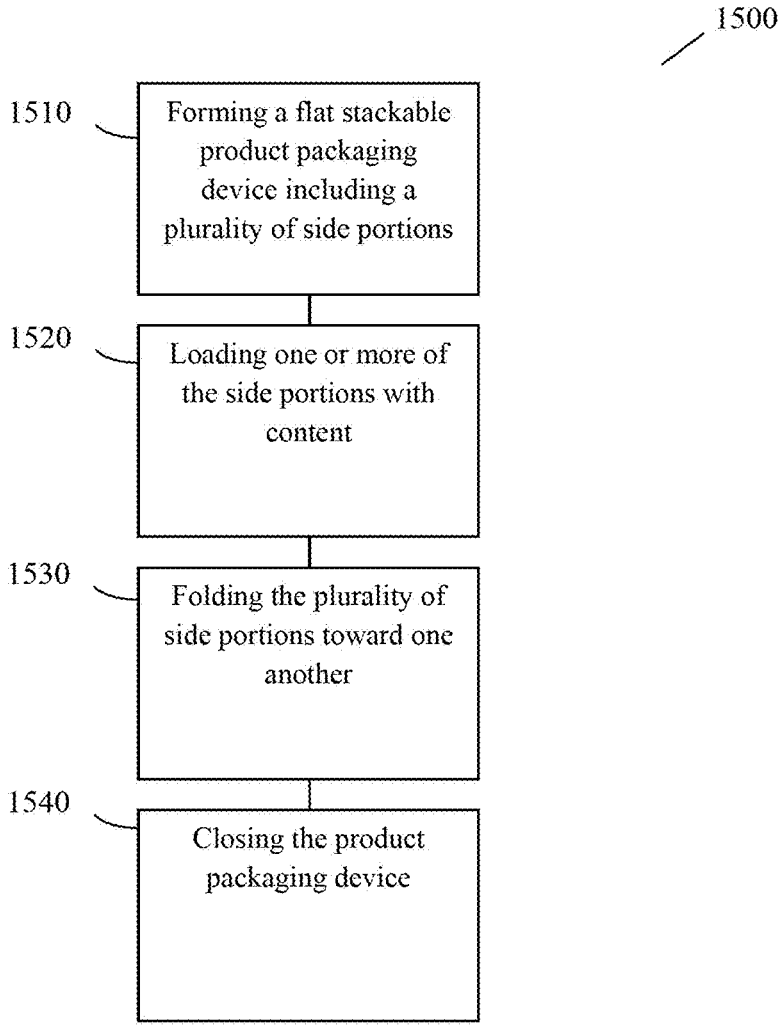
FIG. 15 illustrates a block diagram of a process for loading an embodiment of the invention with content.

FIG. 15 illustrates a block diagram of a process 1500 for loading an embodiment of the invention with content.

Process Block 1510: A flat stackable product packaging device including many side portions (e.g., packaging device 100) is formed by a process, such as thermoforming, injection molding, or any equivalent processes.

Process Block 1520: One or more of the side portions are loaded with content, such as loose items, packaged items, fresh food/fruit, etc.

Process Block 1530: The side portions of the product packaging are folded toward one another. In one example, at least one of the side portions overlaps with another side portion.

Process Block 1540: The product packaging device is closed using a closure portion from the at least one side portion that overlaps the other side portion.

In one embodiment of the invention, process 1500 further includes loading the product packaging device in a can vending machine for dispensing content loaded in the product packaging device. In another embodiment of the invention, process 1500 further includes stacking loaded product packaging devices for display in a retail environment.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An apparatus comprising:

a product packaging device including five side portions, wherein each of the side portions comprises:

a first end portion; and a second end portion, wherein the five side portions are configured for containing products and fold together for closing the product packaging device, wherein one of the first end portion and the second end portion of a first side portion of the five side portions includes a formed closure portion comprising a slot, and the closure portion snaps together with another closure portion of a second side portion of the five side portions for closing the product packaging device, wherein the first side portion completely overlaps with the second side portion closing the product packaging device.

2. The apparatus of claim 1, wherein neighboring side portions share a vertical perimeter that is perforated.

3. The apparatus of claim 2, wherein the vertical perimeter includes a plurality of ventilation openings.

4. The apparatus of claim 2, wherein the first end portion, the second end portion, or both the first end portion and the second end portion have a shape for providing a ventilation opening.

5. The apparatus of claim 4, wherein the product packaging comprises five side portions, and each of the side portions has a curved shape.

6. The apparatus of claim 4, wherein the product packaging device has a cylindrical shape and is sized for dispensing in a can vending machine.

7. The apparatus of claim 6, wherein the product packaging device includes ventilation for loading of fresh food and fruit.

8. The apparatus of claim 4, wherein the product packaging device is stackable within other product packaging devices in a flat and unassembled state.

9. The apparatus of claim 8, wherein the product packaging device is horizontally stackable on top of other product packaging devices in a loaded and assembled state.

10. The apparatus of claim 1, wherein the product packaging device is thermoformed, and comprises recycled and recyclable polyethylene terephthalate (PET) material.

11. A product packaging device comprising:

five side portions, wherein each of the side portions comprises:

a first end portion including a first ventilation portion; and a second end portion including a second ventilation portion, wherein the five side portions are configured for containing products and fold together along perforations for closing the product packaging device, wherein one of the first end portion and the second end portion of a first side portion of the five side portions includes a formed closure portion comprising a slot, and the closure portion snaps together with another closure portion of a second side portion of the five side portions for closing the product packaging device, wherein the first side portion completely overlaps with the second side portion closing the product packaging device.

12. The product packaging device of claim 11, wherein a vertical perimeter of the plurality of side portions includes a plurality of ventilation openings.

13. The product packaging device of claim 11, wherein the first ventilation portion is open, and the second ventilation portion is open.

14. The product packaging device of claim 13, wherein the product packaging device has a cylindrical shape and is sized for dispensing in a can vending machine.

15. The product packaging device of claim 14, wherein the product packaging device is thermoformed and comprises recycled and recyclable polyethylene terephthalate (PET) material.

16. The apparatus of claim 1, wherein five side portions are arranged next to one another, and the first side portion comprises a last side portion of the five side portions.

17. The apparatus of claim 16, wherein the last side portion overlaps with the second side portion creating a closed wrap and engaging an end of the last side portion into an end of the second side portion for snapping the product packaging device closed.

* * * * *